US005166029A

United States Patent [19]

Bayley et al.

[11] Patent Number: 5,166,029

[45] Date of Patent: Nov. 24, 1992

[54] TONER AND DEVELOPER COMPOSITIONS WITH CHARGE ENHANCING ADDITIVES

[75] Inventors: Robert D. Bayley, Fairport; Thomas R. Hoffend, Webster, both of N.Y.

[73] Assignee: Xerox Corporation, Stamford, Conn.

[21] Appl. No.: 775,869

[22] Filed: Oct. 15, 1991

[51] Int. Cl.[5] ..... G03G 9/97
[52] U.S. Cl. ..... 430/110
[58] Field of Search ..... 430/110

[56] References Cited

U.S. PATENT DOCUMENTS 3,850,642 11/1974 Bailey et al. ..... 430/110 X
4,826,749 5/1989 Kawagishi et al. ..... 430/110
4,990,426 2/1991 Diaz et al. ..... 430/110

*Primary Examiner*—Roland Martin
*Attorney, Agent, or Firm*—E. O. Palazzo

[57] ABSTRACT

A toner composition comprised of resin particles, pigment particles, and a charge enhancing additive as represented by the following formula

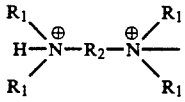

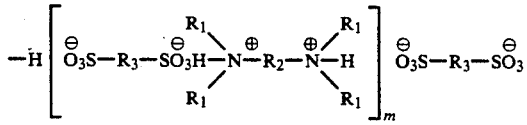

wherein $R_1$ and $R_2$ are independently selected from the group consisting of alkyl, and $R_3$ is an aromatic group, and m represents the number of repeating segments.

22 Claims, No Drawings

TONER AND DEVELOPER COMPOSITIONS WITH CHARGE ENHANCING ADDITIVES

BACKGROUND OF THE INVENTION

The invention is generally directed to toner and developer compositions, and more specifically, the present invention is directed to developer and toner compositions containing charge enhancing additives, which impart or assist in imparting a positive charge to the toner resin particles and enable toners with rapid admix characteristics, stable triboelectric characteristics in embodiments and wherein the fusing properties of the toner resin are relatively constant in embodiments. In one embodiment, there are provided in accordance with the present invention toner compositions comprised of resin particles, pigment particles, and certain diacid, and diamine salt charge enhancing additives. In one embodiment the present invention is directed to toners with charge additives formed by the reaction of a diacid compound, such as a disulfonic acid and a ditertiary amine, thereby permitting charge additives with, for example, multi acid-base salt sites, and with either a monomeric, oligomeric, polymeric and/or cyclic chemical structure. In another embodiment the charge additive selected is formed by the reaction of 1,5-naphthalene disulfonic acid and N,N,N',N'-tetramethylethylene diamine. The aforementioned additives in embodiments of the present invention enable, for example, toners with substantial humidity insensitivity rapid admix of less than about 30 seconds, extended developer life, stable electrical properties, high image print quality with substantially no background deposits, and compatibility with fuser rolls including Viton fuser rolls. Also, the aforementioned toner compositions usually contain pigment particles comprised of, for example, carbon black, magnetites, or mixtures thereof, cyan, magenta, yellow, blue, green, red, or brown components, or mixtures thereof thereby providing for the development and generation of black and/or colored images. The toner compositions of the present invention in embodiments thereof maintain their triboelectric charging characteristics for an extended number of imaging cycles, exceeding, for example, 500,000 in a number of embodiments. The toner and developer compositions of the present invention can be selected for electrophotographic, especially xerographic, imaging and printing processes, including color processes.

Developer compositions with charge enhancing additives, which impart a positive charge to the toner resin, are well known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchloride, tetrafluoroborate, benzene sulfonate, and the like; U.S. Pat. No. 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example, sulfate, sulfonate, nitrate, borate, chlorate, and the halogens such as iodide, chloride and bromide, reference the Abstract of the Disclosure and column 3; a similar teaching is presented in U.S. Pat. No. 4,312,933 which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there is disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014 4,394,430 and 4,560,635 which illustrates a toner with a distearyl dimethyl ammonium methyl sulfate charge additive. One disadvantage associated with the charge additive of the '635 patent resides in its apparent inherent instability in some instances thus rendering it substantially unsuitable as a bulk toner constituent in imaging processes, as the additive may thermally and chemically degrade, and react with other toner components.

The following prior art, all United States patents, are mentioned: U.S. Pat. No. 4,812,381 which discloses toners and developers containing charge control agents comprising quaternary ammonium salts of the formula indicated, for example, in the Abstract of the Disclosure, wherein R is alkyl with from 12 to 18 carbon atoms, and the anion is a trifluoromethylsulfonate; also note, for example, column the information presented in columns 2 and beginning with column 3 of this patent; a similar teaching is presented in U.S. Pat. No. 4,834,921; U.S. Pat. No. 4,490,455 which discloses toners with, for example, amine salt charge enhancing additives, reference the Abstract of the Disclosure for example, and wherein a is an anion including those derived from aromatic substituted sulfonic acids, such as benzene sulfonic acid, and the like, see column 3 beginning at line 33; U.S. Pat.No. 4,221,856 directed to toners with a quaternary ammonium compound wherein A is an anion such as sulfate, sulfonate, nitrate, borate, chlorate, and certain halogens, see the Abstract of the Disclosure; U.S. Pat. No. 32,883 (a reissue of U.S. Pat. No. 4,338,390) illustrates toners with sulfate and sulfonate charge additives, see the Abstract of the Disclosure, wherein $R_4$ is an alkylene, and the anion contains a $R_5$ which is a tolyl group, or an alkyl group of from 1 to 3 carbon atoms, and n is the number 3 or 4; U.S. Pat. No. 4,323,634 which discloses toners with charge additives of the formulas presented in column 3, wherein providing that at least one of the R's is a long chain amido group and X is a halide ion or an organosulfur containing group; U.S. Pat. No. 4,326,019 relating to toners with long chain hydrazinium compounds, wherein the anion A can be a sulfate, sulphonate, phosphate, halides, nitrate, see the abstract of the disclosure for example; U.S. Pat. No. 4,752,550 which illustrates toners with inner salt charge additives, or mixtures of charge additives, see for example column 8; U.S. Pat. No. 4,684,596 which discloses toners with charge additives of the formula provided in column 3 wherein X can be variety of anions such as trifluoromethane sulfonate, and U.S. Pat. No. 4,604,338, 4,792,513, 3,893,935, 4,826,749, and 4,604,338. The disclosures of each of the aforementioned patents are totally incorporated herein by reference.

Illustrated in copending application U.S. Pat. No. 4,937,157, the disclosure of which is totally incorporated herein by reference, are toner compositions comprised of resin, pigment, or dye, and tetraalkyl, wherein alkyl, for example, contains from 1 to about 30 carbon atoms, ammonium bisulfate charge enhancing additives such as distearyl dimethyl ammonium bisulfate, tetramethyl ammonium bisulfate, tetraethyl ammonium bisulfate, tetrabutyl ammonium bisulfate, and preferably dimethyl dialkyl ammonium bisulfate compounds where the dialkyl radicals contain from about 10 to about 30 carbon atoms, and more preferably dialkyl radicals with from about 14 to about 22 carbon atoms, and the like. The aforementioned charge additives can be incorporated into the toner or may be present on the toner surface. Advantages of rapid admix, appropriate triboelectric characteristics, and the like are achieved with many of the toners of the aforementioned copending application. Advantages of the charge additives of the present invention in embodiments thereof over the additives of the aforementioned copending application include improved stable toner admix rate performance; usually more acceptable thermal stability and excellent chemical stability with respect to solvolysis permitting improved shelf stability of, for example, the toner charge enhancing properties, and the like.

Although many charge enhancing additives are known, there continues to be a need for toners with additives, which toners possess many of the advantages illustrated herein. Additionally, there is a need for positive charge enhancing additives which are useful for incorporation into black, and/or colored toner compositions. Moreover, there is a need for colored toner compositions containing certain charge enhancing additives. There is also a need for toner compositions with certain charge enhancing additives, which toners in embodiments thereof possess acceptable substantially stable triboelectric charging characteristics, and excellent admixing properties. Moreover, there continues to be a need for positively charged toner and developer compositions. Further, there is a need for toners with certain charge enhancing additives which can be easily and permanently dispersed into toner resin particles. There also is a need for positively charged black, and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. Nos. 4,265,990; 4,585,884; 4,584,253 and 4,563,408, the disclosures of which are totally incorporated herein by reference. Also, there is a need for toner compositions which have the desired triboelectric charge level, for example from about 10 to about 40 microcoulombs per gram, and preferably from about 10 to about 25 microcoulombs per gram, and admix charging rates of from about 5 to about 60 seconds, and preferably from about 15 to about 30 seconds, as determined by the charge spectrograph, preferably for example at low concentrations, that is for example less than 1 percent, and preferably less than about 0.5 percent of the charge enhancing additive of the present invention.

SUMMARY OF THE INVENTION

It is an object of the present invention to provide toner and developer compositions with charge enhancing additives.

In another object of the present invention there are provided positively charged toner compositions useful for the development of electrostatic latent images including color images.

In yet another object of the present invention there are provided positively charged toner compositions containing the charge additives illustrated herein.

Another object of the present invention resides in providing toner compositions with mixtures of charge enhancing additives wherein one of the additives can be, for example, a quaternary ammonium hydrogen bisulfate, especially trialkyl ammonium hydrogen bisulfate, or a tetraalkyl ammonium sulfonate, such as dimethyl distearyl ammonium sulfonate.

Also, in another object of the present invention there are provided developer compositions with positively charged toner particles, carrier particles, and the enhancing additives illustrated herein, or mixtures of these additives with other known charge enhancing additives.

In yet a further object of the present invention there are provided positively charged toner compositions with desirable admix properties of 30 seconds to 60 seconds as determined by the charge spectrograph, and preferably about 15 seconds for example, and more preferably from between about 5 to about 14 seconds, and acceptable stable triboelectric charging characteristics of from about 10 to about 40 microcoulombs per gram.

Additionally, in a further object of the present invention there are provided positively charged magnetic toner compositions, and positively charged colored toner compositions containing therein, or thereon the charge enhancing additives illustrated herein.

In another object of the present invention that are provided thermally stable charge enhancing additives, that is for example additives which do not decompose at high temperatures, for example, of from about 125° to about 150° C.

Another object of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic, especially xerographic, apparatuses, that is those exceeding 70 copies per minute.

These and other objects of the present invention can be accomplished in embodiments thereof by providing toner compositions comprised of resin particles, pigment particles, and charge enhancing additives. More specifically, the present invention in one embodiment is directed to toner compositions comprised of resin, pigment, or dye, and as a charge additive a component of the following formula

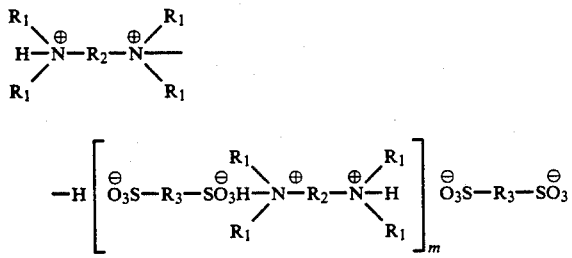

wherein $R_1$ is an alkyl group containing 1 to about 25, and preferably 1 to 6 carbon atoms such as methyl, ethyl, propyl, butyl, pentyl and hexyl groups and mixtures thereof, $R_2$ is an alkyl group containing about 1 to about 25, and preferably 1 to 6 carbon atoms such as methyl, ethyl, propyl, butyl, pentyl and hexyl groups, and also the diamine structure can be a heterocyclic structure such as N,N'-dimethylpiperazine, $R_3$ is aromatic, or aryl group with from between about 6 to about 24 carbon atoms, such as benzene phenyl, and naphthalene, and the like, and m represents the number of repeating segments, and can be zero, 1, 2 or 3. Specific charge additives selected for the toners of the present invention are represented by the following formula

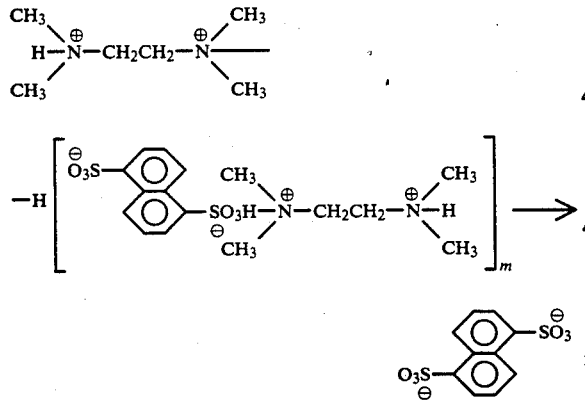

wherein m is as illustrated herein.

Examples of charge additives selected in various effective amounts, such as, for example, from about 0.05 to about 1.0 weight percent, for the toners of the present invention include those illustrated herein, and obtained, for example, from the reaction of 1,4-benzene disulfonic acid, 1,3-benzene disulfonic acid, 2,6-naphthalene disulfonic acid, 2,7-naphthalene disulfonic acid, or 1,5-naphthalene disulfonic acid and a diamine of N,N,N',N'-tetramethylethylene diamine (DADA), N,N,N',N'-tetramethyl-1,4-butane diamine, N,N,N',N'-tetramethyl-1,6-hexane diamine, N,N,N',N'-tetraethyl methylene diamine, N,N,N',N'-tetraethyl ethylene diamine, N,N,N',N'-tetrapropyl ethylene diamine, N,N,N',N'-tetraethyl-1,3-propane diamine, N,N,N',N'-tetraethyl-1,4-butane diamine, N,N,N',N'-tetrapropyl tetramethylene diamine, N,N,N',N'-tetra-n-butyl methylene diamine, or dimethyl piperazine, diethyl piperazine, and the like. Specific examples of charge additives include N,N,N',N'-tetramethylethylene diamine-1,5-naphthalene-disulfonic acid salt, N,N,N',N'-tetraethyl ethylene diamine-1,5-naphthalene disulfonic acid salt, N,N,N',N'-tetraethyl-1,3-propane diamine-1,5-naphthalene disulfonic acid salt, or dimethyl piperazine-1,5-naphthalene disulfonic acid salt, N,N,N',N'-tetramethyl-1,4-butane diamine-1,5-naphthalene disulfonic acid salt.

Examples of second charge additives selected in effective amounts of, for example, from about 0.05 to about 1.0 weight percent, than can be utilized with the aforementioned first charge additive include, for example, hydrogen ammonium bisulfate charge enhancing additives such as distearyl methyl hydrogen ammonium bisulfate, trimethyl hydrogen ammonium bisulfate, triethyl hydrogen ammonium bisulfate, tributyl hydrogen ammonium bisulfate, didodecyl methyl hydrogen ammonium bisulfate, dihexadecyl methyl hydrogen ammonium bisulfate, distearyl dimethyl ammonium methyl sulfate, and the like in embodiments, reference the U.S. patents mentioned herein and the copending patent application. With mixtures from about 0.05 to about 1.0 percent by weight of the charge enhancing additive of the present invention can be selected, and from about 0.05 to about 1.0 percent of a second charge enhancing additive can be selected in embodiments of the present invention. Other amounts of mixtures may also be selected in embodiments of the present invention.

The aforementioned charge additives can be incorporated into the toner, may be present on the toner surface, or may be present on toner surface additives such as colloidal silica particles. Advantages of rapid admix, appropriate triboelectric characteristics, and the like are achieved with many of the aforementioned toners of the present invention.

In another embodiment of the present invention, there are provided subsequent to known micronization and classification toner particles with an average diameter of from about 7 to about 20 microns comprised of resin particles, pigment particles, and the charge enhancing additive.

A typical preparation for a charge enhancing additive of the present invention is as illustrated herein and includes the reaction between 1,5-naphthalene disulfonic acid and N,N,N',N'-tetramethylethylene diamine as follows:

In a 3 liter jacketed glass reaction kettle equipped with stainless stirrer and reflux condenser were added, at 25° C., 1.428 liters of isopropanol and 171.53 grams (0.476 moles) of 1,5-naphthalene disulfonic acid. Upon dissolving the above with stirring, there was added slowly with continued stirring a mixture of 55.32 grams (0.476 moles) of N,N,N',N'-tetramethylethylene diamine dissolved in 0.238 liter of isopropanol. Upon complete addition of the diamine, the temperature of the reactor was increased until refluxing commenced (approximately 83° C.) and maintained at reflux for 30 minutes before cooling to room temperature, approximately 23° C. After cooling the reaction media to room temperature, the product was filtered through a buchner funnel and washed with cold clean isopropanol to remove residual starting reactants. Drying was accomplished in a vacuum oven overnight at 35° C. to provide a white crystalline product N,N,N',N'-tetramethylethylene diamine-1,5-naphthalene disulfonic acid salt, or DADA. The product DADA was found to have a melting point onset of about 347° C. prior to decomposition. The resulting product can be identified by a number of techniques including melting point information, differential scanning calorimetry, infrared spectra, carbon, and proton nuclear magnetic resonance, ion chromotography, elemental analysis, and the like.

The toner compositions of the present invention can be prepared by a number of known methods, such as admixing and heating resin particles such as styrene butadiene copolymers, pigment particles such as magnetite, carbon black, like REGAL 330®, or mixtures thereof, and preferably from about 0.5 percent to about 5 percent of the aforementioned charge enhancing additives, or mixtures of charge additives, in a toner extrusion device, such as the ZSK53 extruder available from Werner Pfleiderer, and removing the formed toner composition from the device. Subsequent to cooling, such as cooling in air or water, the toner composition is subjected to grinding utilizing, for example, a Sturtevant micronizer for the purpose of achieving toner particles with a volume median diameter of less than about 25 microns, and preferably of from between about 7 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Illustrative examples of suitable toner resins selected for the toner and developer compositions of the present invention include polyamides, polyolefins, styrene acrylates, styrene methacrylate, styrene butadienes, crosslinked styrene polymers, epoxies, polyurethanes, vinyl resins, including homopolymers or copolymers of two or more vinyl monomers; and polyesters, such as those obtained from the polymeric esterification of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like. Specific examples of toner resins include styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, homopolymers of the aforementioned styrene polymers may be selected.

As one toner resin, there can be selected the esterification product of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; PLIOLITES®; suspension polymerized styrene butadienes, reference U.S. Pat. No. 4,558,108, the disclosure of which is totally incorporated herein by reference; polyester resins obtained from the reaction of bisphenol A and propylene oxide followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a molecular weight of from about 500 to about 20,000, such as polyethylene, polypropylene, and paraffin waxes can be included in, or on the toner compositions as fuser roll release agents. These waxes are usually present in effective amounts of, for example, from between about 1 to about 10 weight percent.

The resin particles are present in a sufficient, but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive of the present invention may be coated on the pigment particle. When used as a coating, the charge enhancing additive of the present invention is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black, like REGAL 330®, nigrosine dye, aniline blue, magnetite, or mixtures thereof. The pigment can be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles may be selected.

When the pigment particles are comprised of magnetites, thereby enabling, for example, single component toners, which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

There can also be blended with the toner compositions of the present invention external additive particles including flow aid additives, which additives are usually present on the surface thereof. Examples of these additives include colloidal silicas, such as AEROSIL® like AEROSIL R972®, metal salts and metal salts of fatty acids inclusive of zinc stearate, aluminum oxides, cerium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL® like AEROSIL R972 ®, can be surface treated with the charge additives of the present invention illustrated herein in an amount of from about 1 to about 30 weight percent, and preferably 10 weight percent followed by the addition thereof to the toner in an amount of from 0.1 to 10 and preferably 0.1 to 1 weight percent.

Also, there can be included in the toner compositions of the present invention as indicated herein low molecular weight waxes, such as polypropylenes and polyethylenes commercially available from Allied Chemical and Petrolite Corporation, Epolene N-15 commercially available from Eastman Chemical Products, Inc., Viscol 550-P, a low weight average molecular weight polypropylene available from Sanyo Kasei K.K., and similar materials. The commercially available polyethylenes selected have, it is believed, a molecular weight of from about 1,000 to about 1,500, while the commercially available polypropylenes utilized for the toner compositions of the present invention are believed to have a molecular weight of from about 4,000 to about 7,000. Many of the polyethylene and polypropylene compositions useful in the present invention are illustrated in British Patent No. 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Encompassed within the scope of the present invention are colored toner and developer compositions comprised of toner resin particles, optional carrier particles, the charge enhancing additives illustrated herein, and as pigments or colorants red, blue, green, brown, magenta, cyan and/or yellow particles, as well as mixtures therof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, especially a polymeric coating, the coating generally being comprised of terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black like VULCAN ® carbon black available from Cabot Corporation, in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example Kynar and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 500, and preferably about 175 microns thereby permitting them to possess sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier.

The toner composition of the present invention can be prepared by a number of known methods as indicated herein including extrusion, melt blending the toner resin particles, pigment particles or colorants, and the charge enhancing additive of the present invention as indicated herein, followed by mechanical attrition and optional classification to provide toner particles with an average diameter of from between about 7 to about 25 microns. Other methods include those well known in the art such as spray drying, melt dispersion, extrusion processing, dispersion polymerization, and suspension polymerization. Also, as indicated herein the toner composition without the charge enhancing additive can be prepared, followed by the addition of surface treated with charge additive colloidal silicas. More specifically, the toner compositions of the present invention can be prepared by a number of known methods, such as admixing and heating resin particles such as styrene butadiene copolymers, pigment particles such as magnetite, carbon black, or mixtures thereof, and preferably from about 0.5 percent to about 5 percent of the aforementioned charge enhancing additive, or mixtures of charge additives, in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from between about 7 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter.

Also, the toner compositions of the present invention in embodiments thereof possess desirable narrow charge distributions, optimal charging triboelectric values, preferably of from 10 to about 40, and more preferably from about 10 to about 35 microcoulombs per gram with from about 0.1 to about 5 weight percent in one embodiment of the charge enhancing additive.

When the charge additive of the present invention is utilized in admixtures with other additives, for example alkyl pyridinium halides, organic sulfates, organic sulfonates, the bisulfates illustrated in the copending applications mentioned herein, distearyl dimethyl ammonium methyl sulfate, and the like, generally there is present in the mixture an effective amount of each additive, such as for example from about 30 to about 80 percent by weight of the first additive of the present invention, and from about 20 to about 70 weight percent of the second charge additive in an embodiment of the present invention, from about 40 to about 60 percent by weight of the first additive of the present invention, and from about 60 to about 40 weight percent of the second charge additive in another embodiment of the present invention.

The following Examples are being supplied to further define various species of the present invention, it being noted that these Examples are intended to illustrate and not limit the scope of the present invention. Parts and percentages are by weight unless otherwise indicated.

EXAMPLE I

Chemical Synthesis of a Charge Enhancing Additive From the Reaction of 1,5-Naphthalenedisulfonic Acid and N,N,N',N'-Tetramethylethylene Diamine (DADA)

In a 3 liter jacketed glass reaction kettle equipped with stainless stirrer and reflux condenser were added, at 2° C., 1.428 liters of isopropanol and 171.53 grams (0.476 moles) of 1,5-naphthalene disulfonic acid. Upon dissolving the above with stirring, there was added slowly, with continued stirring, a mixture of 55.32 grams (0.476 moles) of N,N,N',N'-tetramethylethylene diamine dissolved in 0.238 liter of isopropanol. Upon complete addition of the diamine, the temperature of the reactor was increased until refluxing commenced (approximately 83° C.) and maintained at reflux for 30 minutes before cooling back to room temperature, approximately 23° C. After cooling the reaction media to room temperature, about 25° C., the product was filtered through a buchner funnel and washed with cold clean isopropanol to remove residual starting reactants. Drying was accomplished in a vacuum oven overnight at 35° C. to provide a white crystalline product. The product N,N,N',N'-tetramethylethylene diamine-1,5-naphthalene disulfonic acid salt (DADA) was found to have a melting point onset of about 347° C. prior to decomposition. The resulting product was identified by a number of techniques including melting point information, differential scanning calorimetry, infrared spectra, carbon, and proton nuclear magnetic resonance, ion chromotography, elemental analysis, and the like.

EXAMPLE II

There was prepared in an extrusion device, available as ZSK28 from Werner Pfleiderer, a toner composition by adding thereto 80.13 percent by weight of suspension polymerized styrene butadiene copolymer resin particles (87/13), reference U.S. Pat. No. 4,558,108, the disclosure of which is totally incorporated herein by reference; 16.4 percent by weight of the magnetite MAPICO BLACK®; 3.15 percent by weight of REGAL 330® carbon black; and 0.5 percent by weight of the charge enhancing additive N,N,N',N'-tetramethylethylene diamine-1,5-naphthalene disulfonic acid salt (DADA) obtained from Example I. The toner product which was extruded at a rate of 15 pounds per hour reached a melting temperature of 381° F. The strands of melt mixed product exiting from the extruder were cooled by immersing them in a water bath maintained at room temperature, about 25° C. Subsequent to air drying, the resulting toner was subjected to grinding in a Sturtevant micronizer enabling particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns.

Subsequently, the above formulated toner, 3 parts by weight, was mixed with 97 parts by weight of a carrier containing a steel core with a polymer mixture thereof, 0.70 percent by weight, which polymer mixture contained 40 parts by weight of polyvinylidene fluoride, and 60 parts by weight of polymethyl methacrylate, and wherein mixing was accomplished in a paint shaker for 10 minutes. There resulted on the toner composition, as determined in the known Faraday Cage apparatus, a positive triboelectric charge of 18 microcoulombs per gram.

EXAMPLE III

There was prepared in an extrusion device, available as ZSK28 from Werner Pfleiderer, a toner composition by adding thereto 80.13 percent by weight of suspension polymerized styrene butadiene copolymer resin particles (87/13), reference U.S. Pat. No. 4,558,108, the disclosure of which is totally incorporated herein by reference; 16.4 percent by weight of the magnetite MAPICO BLACK®; 3.15 percent by weight of REGAL 330® carbon black; and 2.0 percent by weight of the charge enhancing additive DADA obtained from Example I. The toner was extruded at a rate of 14 pounds per hour and reached a temperature of 383° F. The toner strands of melt mixed product exiting from the extruder were cooled by immersion in a water bath by repeating the procedure of Example II. Subsequently, the resulting toner was subjected to grinding in a Sturtevant micronizer enabling particles with a volume median diameter of from 8 to 12 microns as measured by a Coulter Counter. Thereafter, the aforementioned toner particles were classified in a Donaldson Model B classifier for the purpose of removing fine particles, that is those with a volume median diameter of less than 4 microns.

Subsequently, the above formulated toner, 3 parts by weight, was mixed with 97 parts by weight of a carrier containing a steel core with a polymer mixture thereof, 0.70 percent by weight, which polymer mixture contained 40 parts by weight of polyvinylidene fluoride and 60 parts by weight of polymethyl methacrylate, and wherein mixing was accomplished in a paint shaker for 10 minutes. There resulted on the toner composition, as determined in the known Faraday Cage apparatus, a positive triboelectric charge of 19 microcoulombs per gram.

EXAMPLE IV

A slurry of 10.0 grams of AEROSIL R972® (Degussa) in about 500 milliliters of methanol were mixed thoroughly for 10 minutes in an explosion proof blender. The charge enhancing additive compound obtained by the process of Example I, namely DADA (1.0 gram) was dissolved in 50 milliliters of additional methanol solvent, followed by adding the resulting mixture to the above slurry of the AEROSIL® and methanol. Mixing was accomplished for about 10 minutes. The resulting mixture was then transferred to a round-bottom flask surrounded by a water bath, which water bath was heated to about 40° C., and thereafter the mixture resulting in the flask was evaporated to dryness on a rotoevaporator. The residual solvent was then dried in a vacuum oven for 24 hours, then placed in a blender equipped with a 4 blade agitator, and fluffed to a powdery consistency. There resulted a fine powder comprised of AEROSIL® particles coated with the charge enhancing additive DADA. A toner can be prepared by repeating the procedure of Example III with the exception that there is selected as the charge additive the composite of this Example, or wherein the composite of this Example IV is selected as a surface component.

Other modifications of the present invention may occur to those skilled in the art subsequent to a review of the present application, and these modifications, including equivalents thereof, are intended to be included within the scope of the present invention.

What is claimed is:

1. A positively charged toner composition comprised of resin particles, pigment particles, and a charge enhancing additive as represented by the following formula

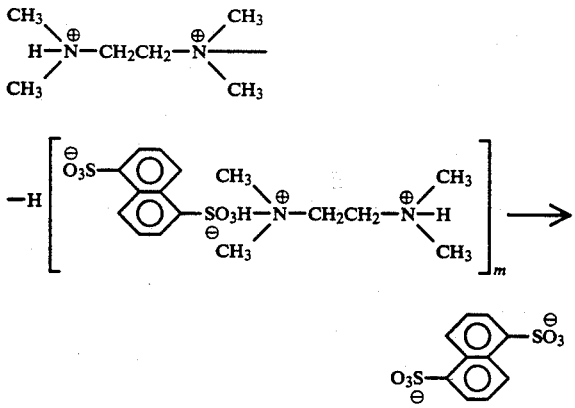

wherein m is zero, 1, 2 or 3.

2. A toner composition in accordance with claim 1 wherein the charge additive is present in an amount of from about 0.05 to about 5 weight percent.

3. A toner composition in accordance with claim 1 wherein the charge additive is present in an amount of from about 0.1 to about 3 weight percent.

4. A toner composition in accordance with claim 1 wherein the charge additive is incorporated into the toner.

5. A toner composition in accordance with claim 1 wherein the charge additive is present on the surface of the toner composition.

6. A toner composition in accordance with claim 5 wherein the charge additive is contained on colloidal silica particles.

7. A toner composition in accordance with claim 1 with an admix time of from between about 15 and 30 seconds.

8. A toner composition in accordance with claim 1 with an admix time of from about 1 to about 14 seconds.

9. A toner composition in accordance with claim 1 with a triboelectric charge of from about 10 to about 40 microcoulombs per gram.

10. A toner composition in accordance with claim 1 wherein a colloidal silica is treated with the charge enhancing additive, and the resulting composition is present on the surface of the toner.

11. A toner composition in accordance with claim 1 wherein the resin particles are selected from the group consisting of styrene polymers, polyesters, and mixtures thereof.

12. A toner composition in accordance with claim 1 wherein the resin particles are selected from the group consisting of styrene acrylates, styrene methacrylates, polyesters, and styrene butadienes.

13. A toner composition in accordance with claim 1 containing a wax component with a weight average molecular weight of from about 500 to about 7,000.

14. A toner composition in accordance with claim 13 wherein the wax component is selected from the group consisting of polyethylene, polypropylene and mixtures thereof.

15. A toner composition in accordance with claim 1 containing external additives selected from the group consisting of metal salts of a fatty acid, colloidal silicas, and mixtures thereof.

16. A toner composition in accordance with claim 1 wherein the pigment particles are carbon black, magnetites, or mixtures thereof, cyan, magenta, yellow, red, blue, green, brown, and mixtures thereof.

17. A developer composition comprised of the toner composition of claim 1 and carrier particles.

18. A developer composition in accordance with claim 17 wherein the carrier particles are ferrites, steel, or an iron powder.

19. A developer composition in accordance with claim 17 wherein the carrier particles are comprised of a core with a polymer coating thereover.

20. A developer composition in accordance with claim 19 wherein the coating is selected from the group consisting of a methyl terpolymer, a polyvinylidine fluoride, a polymethyl methacrylate, and a mixture of polymers not in close proximity in the triboelectric series.

21. A method of imaging which comprises formulating an electrostatic latent image on a negatively charged photoconductive imaging member, affecting development thereof with the toner composition of claim 1, and thereafter transferring the developed image to a suitable substrate.

22. A method of imaging in accordance with claim 21 wherein the transferred image is permanently fixed to the substrate.

* * * * *